US006053345A

United States Patent [19]

Jones

[11] Patent Number: 6,053,345

[45] **Date of Patent: *Apr. 25, 2000**

[54] CONTAINER WITH ERGONOMICALLY POSITIONED HAND GRIPS

[76] Inventor: Peter Timothy Jones, 180 Bamford Lane, Kirwan, Townsville, QLD 4817, Australia

[ * ] Notice: This patent is subject to a terminal disclaimer.

[21] Appl. No.: 09/124,905

[22] Filed: Jul. 30, 1998

Related U.S. Application Data

[63] Continuation of application No. 08/809,076, Jul. 3, 1997.

[30] Foreign Application Priority Data

Sep. 14, 1994 [AU] Australia ..... PM8097
Sep. 14, 1995 [AU] Australia ..... PCT/AU95/00608

[51] Int. Cl.[7] ..... B65D 25/30

[52] U.S. Cl. ..... 215/398; 215/384; 220/770; 206/511

[58] Field of Search ..... 215/398, 396, 215/384; 206/509, 511; 220/772, 771, 770, 755

[56] References Cited

U.S. PATENT DOCUMENTS

| | | |
|---|---|---|
| 1,447,838 | 3/1923 | Donaldson . |
| 3,270,922 | 9/1966 | Schmidt . |
| 4,541,529 | 9/1985 | Hestehave et al. . |
| 4,666,054 | 5/1987 | Jaicks . |
| 4,792,170 | 12/1988 | Gipson et al. . |
| 4,805,793 | 2/1989 | Brandt et al. . |
| 4,969,571 | 11/1990 | Bartz . |
| 5,226,574 | 7/1993 | Durinzi, Jr. . |

FOREIGN PATENT DOCUMENTS

| | | |
|---|---|---|
| 226138 | 2/1963 | Austria . |
| 1355751 | 7/1962 | France . |
| 1.465.560 | 1/1967 | France . |
| 1.565.679 | 5/1969 | France . |
| 3443423 | 5/1986 | Germany . |
| 380639 | 9/1964 | Switzerland . |
| 967741 | 8/1964 | United Kingdom . |
| 2105674 | 3/1983 | United Kingdom . |

*Primary Examiner*—Stephen Castellano
*Attorney, Agent, or Firm*—Burns, Doane, Swecker & Mathis, L.L.P.

[57] ABSTRACT

A container of the type which can be lifted and carried by a person, the container comprising a bottom wall, a top wall, a back wall, which faces the person's body when the container is carried, a front wall opposite to the back wall, two opposed side walls extending between the back and front walls, a first hand-grippable portion positioned at the juncture between the bottom wall and one of the side walls, and a second hand-grippable portion positioned adjacent the juncture between the front wall and the other of the side walls.

8 Claims, 1 Drawing Sheet

CONTAINER WITH ERGONOMICALLY POSITIONED HAND GRIPS

This application is a continuation of application Ser. No. 08/809,076, filed Jul. 3, 1997.

This invention relates to a container and particularly to a container which is configured in such a manner that it can be lifted only in an ergonomically correct manner.

BACKGROUND ART

Almost all current containers which are designed to be lifted and carried by a person do so by providing a handle on the top of the container. The handle forces the person to carry the container to one side of the body which places stresses and strains on the vertebrae in the lumbar region of the back and is potentially crippling. The awkwardness of having a handle on a container lends itself to a hazardous situation every time the container is manually handled when full or partially full. Other injuries that are experienced as a direct result of mishandling the container includes neck, shoulder and arm injuries, curs and abrasions, sprains and strains to other parts of the person's body. Pouring the contents of the container again requires an awkward and unnatural pose to be adopted by the person, which again adds to injury.

In Australia alone, work-place injuries cost approximately ten billion dollars per year in reported cases. It is further estimated that for every reported case, there are approximately four unreported cases. This then equates to an approximate loss of forty billion dollars per year. Statistics show that between 25–37% of work-place injuries are directly related to injuries sustained from incorrect manual handling techniques.

SUMMARY OF THE INVENTION

The present invention has been developed to provide a container which can be lifted and carried in an ergonomically correct position. This has been achieved by providing hand grippable portions which are positioned such that when the container is lifted and carried by the hand grippable portions, the ergonomically correct posture is provided.

It is an object of the invention to provide a container which may overcome the abovementioned disadvantages or provide the public with a useful and commercial choice.

In one form, the invention resides in a container of the type which can be lifted and carried by a person, the container being provided with a first hand grippable portion on a bottom wall and adjacent one side of the container, and a second hand grippable portion on a side wall and adjacent an opposed side of the container.

By having the hand grippable portions provided in the above-referenced manner, a person can lift a container by gripping the hand grippable portion on the bottom wall, and can steady the container with the second hand grippable portion and in doing so will adopt a posture which is more ergonomically correct than would be the case if the container was lifted by a carry handle.

The container may be of the type which can contain liquids, flowable solids, solids, and the like. The size of the container can vary depending on the shape, size and weight of the contents of the container. For containers holding liquids, a typical volume will be between 10–53 liters. Larger containers can, of course, be used if the contents held by the containers are relatively light-weight.

The shape of the container can vary to suit the contents, storage, transportation, and the like. Common containers are those which are substantially rectangular when viewed in plan and side and these containers are typically formed from blow-moulded or injection-moulded plastics and hold a variety of liquids. Other common containers are those which are substantially cylindrical or drum-like in configuration. The container can be made from metal.

The container may be provided with an outlet or an inlet/outlet. For containers containing solids, the outlet may be in the form of a lid which can be of various conventional designs. For containers containing liquids, the outlet may be in the form of a pouring spout which is typically located on the top wall and adjacent a front side wall of the container to facilitate pouring.

The first and second hand grippable portions may comprise recesses in or on the container into which at least a portion of the person's hand can pass. The recesses may be designed to not project outwardly from the periphery of the container, thereby facilitating storage and stacking of adjacent containers. However, in certain circumstances it may be necessary to form the recesses in a protuberance on the outside of the container. The hand grippable portions may also comprise projections on the outside of the container which can be configured to be comfortably gripped by the person's hand.

To assist in stacking and carrying of multiple containers, each container may be provided with projections and recesses which can mate with each other when adjacent containers are placed together. The projections and recesses may be provided on a top wall and bottom wall of the container such that when a container is placed on top of a lower container, the projections and recesses mate. If the bottom wall has a recess, this may form the or part of the hand grippable portion.

It is possible for side walls of the container to also include projections and recesses such that containers stacked in a side-by-side relationship can also be held together more securely.

If the container is provided with an outlet on the top wall, the outlet may be configured to function as a projection which can pass within a recess on a bottom wall of a second container which can be stacked on top of the first container.

BRIEF DESCRIPTION OF THE DRAWINGS

An embodiment of the invention will be described with reference to the accompanying drawings in which.

BEST MODE

Figure 1:
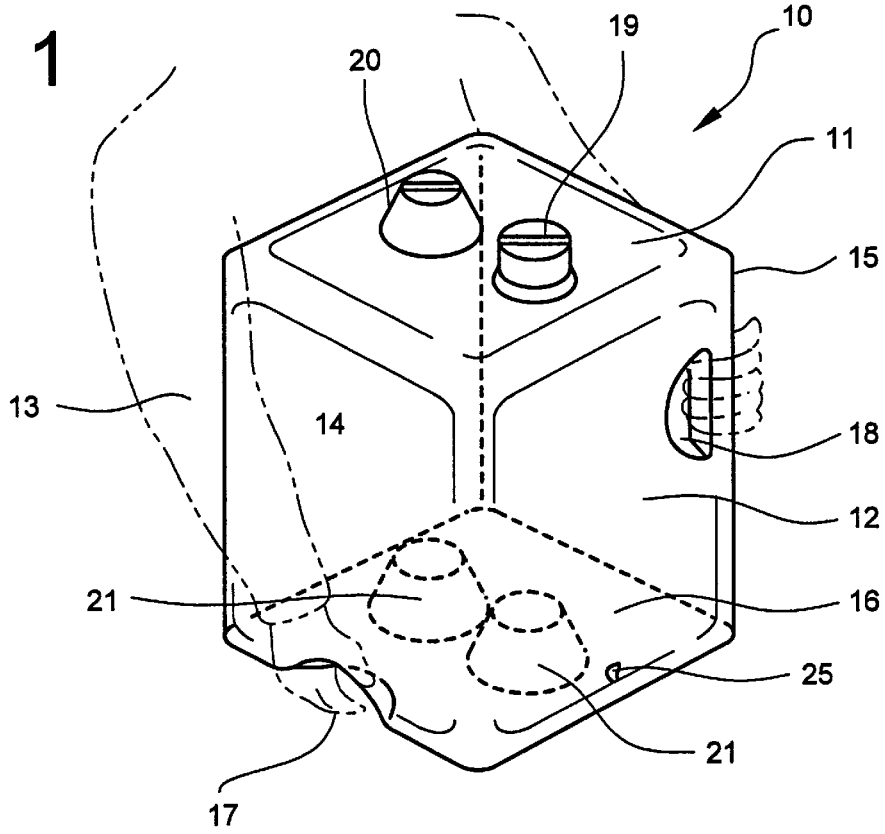
FIG. 1 is a view of a container according to an embodiment of the invention.

Referring to the drawings, there is shown a container 10 which in the embodiment is a blow-moulded plastic container being substantially square when viewed in plan and rectangular when viewed in side elevation. The container has a top wall 11, a front wall 12, a back wall 13, a pair of opposed side walls 14, 15 and a bottom wall 16, each wall is substantially planar apart from a slight bevelling or curvature between a wall and an adjacent wall. In the embodiments, the container has an internal volume of 20–30 liters.

To prevent unsafe lifting of the container, the container is provided with hand grippable portion which are designed such that the container can be lifted in an ergonomically correct posture. The hand grippable portions comprise a first portion 17 and a second portion 18. First portion 17 comprises a recess blow-moulded into the container on bottom wall 16 and adjacent side wall 14. The recess is sufficiently large to allow a person's hand to enter into the recess and to grip the container. First portion 17 provides the lifting effect of the container.

Second portion 18 is also a recess blow-moulded into the container on front wall 12 and adjacent side wall 15. The recess is also sufficiently large to allow a person's fingers to extend into the recess and to grip the container. This portion is provided to steady or position the container while being lifted or poured.

Top wall 11 of the container includes a pouring spout 19 which has a plastic lid screw-threaded thereon. The spout 19 is adjacent front wall 12 as is conventional to allow easy pouring of the contents of the container. Behind spout 19 is provided a projection 20 which is frusto-conical in configuration.

Figure 2:
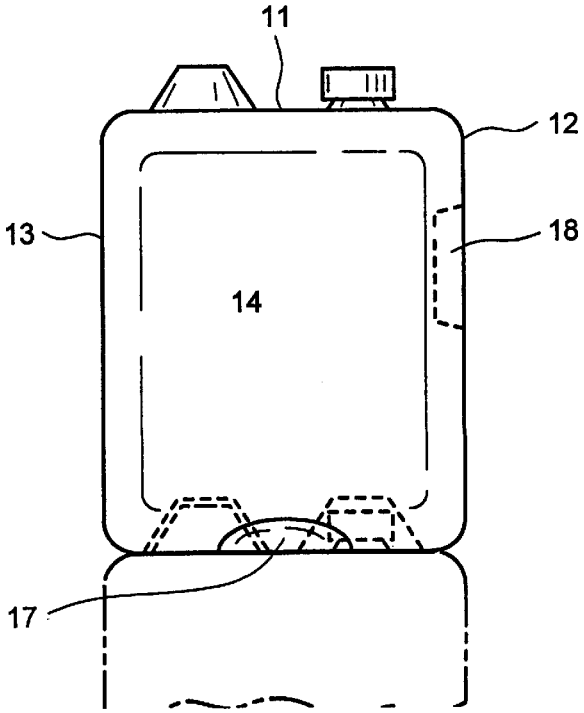
FIG. 2 is a side view of the container of FIG. 1 showing how it can be stacked.

On bottom wall 16 is provided a pair of frusto-conical recesses 21, 22 which are positioned such that they mate with a projection 20 and a spout 19 of a lower container as illustrated in FIG. 2. This arrangement of projections and recesses provides stability to containers as they are stacked on top of each other. Also, for containers containing fairly light-weight contents, two or more stacked containers can be lifted and moved by a single person with little likelihood of the stack toppling over during the lifting or moving process. A bottom tap 25 can be provided to drain the container if it contains liquids.

To lift the container, a person approaches the container with the pouring spout away from the person. The person's right foot is positioned to the rear of the container and the left foot to the side of the container. The person squats down with knees bent and back straight and head up. The person's right hand is placed in the bottom recess 17 and the left hand placed in the front recess 18. The container is lifted and pulled towards the person's stomach and is lifted using thigh and buttock muscles, keeping the back straight. To empty the container, the person bends forwardly which will cause the contents of the container to pour through spout 19, or can move the container onto the hip area followed by tipping.

It can be seen that the container can be lifted and carried in an ergonomically correct posture and there is a reduced likelihood of back injury. If the container is not provided with a carrying handle, there is a reduced possibility that the container can be incorrectly lifted.

The container in the embodiment is made in a squatter more square configuration and it is found that this provides more than 30% extra volume to the container. Stability during stacking is also improved. The recesses 21 in the bottom of the container can also function to provide strength to the bottom of the container, to provide the bottom wall from bowing under the weight of the contents in the container.

In a variation to the illustrated container, recesses 21 may be positioned at 90° to that illustrated so that one of the recesses 21 can also form part of hand grippable recess 17.

It should be appreciated that various other changes and modifications may be made to the embodiment described without departing from the spirit and scope of the invention.

I claim:

1. A container which can be lifted and carried by a person, comprising:

a bottom surface;

a top surface located opposite from said bottom surface;

a front surface;

a rear surface located opposite from said front surface;

a first side surface;

a second side surface located opposite from said first side surface;

a first hand grippable portion located adjacent said bottom surface and said first side surface, said first hand grippable portion extending only along a portion of a circumference of said bottom surface; and a second hand grippable portion located adjacent said second side surface and said front surface;

wherein said first hand grippable portion is at least partially recessed in said first side surface.

2. The container of claim 1, wherein said container is rectangular.

3. The container of claim 1, wherein said bottom surface includes at least one recess for receiving a projection on an adjacent container.

4. A container which can be lifted and carried by a person, comprising:

a bottom surface;

a top surface located opposite from said bottom surface;

a front surface;

a rear surface located opposite from said front surface;

a first side surface;

a second side surface located opposite from said first side surface;

a first hand grippable portion located adjacent said bottom surface and said first side surface, said first hand grippable portion being of limited circumferential extent with respect to a circumference of said bottom surface; and a second hand grippable portion located adjacent said second side surface and said front surface;

wherein said first hand grippable portion is at least partially recessed in said first side surface.

5. The container of claim 4, wherein said container is rectangular.

6. The container of claim 4, wherein said bottom surface includes at least one recess for receiving a projection on an adjacent container.

7. A container which can be lifted and carried by a person, comprising:

a bottom surface;

a top surface located opposite from said bottom surface;

a front surface;

a rear surface located opposite from said front surface;

a first side surface;

a second side surface located opposite from said first side surface;

a first hand grippable portion located adjacent said bottom surface and said first side surface, said first hand grippable portion extending only along a portion of a circumference of said bottom surface; and a second hand grippable portion located adjacent said second side surface and said front surface;

wherein said first hand grippable portion is at least partially recessed in said first side surface and said bottom surface.

8. A container which can be lifted and carried by a person, comprising:

a bottom surface;

a top surface located opposite from said bottom surface;

a front surface;

a rear surface located opposite from said front surface;

a first side surface;

a second side surface located opposite from said first side surface;

a first hand grippable portion located adjacent said bottom surface and said first side surface, said first hand grippable portion being of limited circumferential extent with respect to a circumference of said bottom surface; and a second hand grippable portion located adjacent said second side surface and said front surface;

wherein said first hand grippable portion is at least partially recessed in said first side surface and said bottom surface.

* * * * *